US006588956B1

(12) United States Patent
Gennuso, Jr.

(10) Patent No.: US 6,588,956 B1
(45) Date of Patent: Jul. 8, 2003

(54) CLEANING APPARATUS

(76) Inventor: Frankie J. Gennuso, Jr., Rt. 16, Box 4200, Livingston, TX (US) 77351

( * ) Notice: Subject to any disclaimer, the term of this patent is extended or adjusted under 35 U.S.C. 154(b) by 0 days.

(21) Appl. No.: 10/266,255

(22) Filed: Oct. 3, 2002

(51) Int. Cl.[7] ..... A47L 13/22; A47L 13/26

(52) U.S. Cl. ..... 401/23; 15/144.1; 15/144.2; 15/209.1; 15/228; 401/26; 401/27; 401/137; 401/203; 401/266

(58) Field of Search ..... 401/23, 26, 27, 401/137, 203, 204, 289, 290, 282, 266; 15/144.1, 144.2, 172, 209.1, 228

(56) References Cited

U.S. PATENT DOCUMENTS

| | | | | | |
|---|---|---|---|---|---|
| 1,293,257 | A | * | 2/1919 | Vargha | 15/172 |
| 2,780,821 | A | | 2/1957 | Carter | 15/128 |
| 3,800,354 | A | | 4/1974 | Stephens | 15/236 |
| 3,968,535 | A | | 7/1976 | Nichols, Jr. | 15/105 |
| 4,032,239 | A | * | 6/1977 | Maupin | 15/228 |
| 4,066,366 | A | | 1/1978 | Reynolds | 401/285 |
| 4,313,237 | A | | 2/1982 | Smith | 15/23 |
| 4,315,342 | A | | 2/1982 | Ash | 15/121 |
| 4,574,722 | A | | 3/1986 | Orita et al. | 114/222 |
| 5,035,022 | A | * | 7/1991 | Iuliano et al. | 15/118 |
| 5,153,962 | A | | 10/1992 | Ritter | 15/28 |
| 5,396,677 | A | | 3/1995 | Rissik et al. | 15/1.7 |
| 5,425,589 | A | * | 6/1995 | Griffin et al. | 401/27 X |
| 5,560,068 | A | * | 10/1996 | Blake | 15/172 X |
| 5,625,918 | A | | 5/1997 | Kleson et al. | 15/119.2 |
| 5,653,247 | A | | 8/1997 | Murakami | 134/80 |
| 5,819,354 | A | | 10/1998 | Alonso et al. | 15/104.05 |
| 5,857,235 | A | | 1/1999 | Morris | 15/223 |
| 5,864,911 | A | | 2/1999 | Arnoux et al. | 15/23 |
| 5,988,924 | A | | 11/1999 | Chen | 15/354 |
| 6,016,924 | A | | 1/2000 | Caliva | 210/528 |
| 6,170,108 | B1 | | 1/2001 | Knight | 15/29 |

* cited by examiner

*Primary Examiner*—Gregory L. Huson
*Assistant Examiner*—Kathleen J. Prunner

(57) ABSTRACT

A cleaning apparatus for effectively and efficiently cleaning a broad surface includes a handle member, a pivot structure attached to a distal end of the handle member, a plurality of arms extending from the pivot structure, a center pad attached to the pivot structure, a plurality of outer pads attached to a distal end of the arms, and a plurality of cover members attached to the pads. The center pad is rotatably attached to the pivot structure for allowing rotation during cleaning of a surface. The outer pads are pivotally attached to the arms for conforming to the shape of the surface being cleaned.

20 Claims, 6 Drawing Sheets

CLEANING APPARATUS

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to cleaning devices and more specifically it relates to a cleaning apparatus for effectively and efficiently cleaning a broad surface. The present invention is particularly useful for cleaning a surface or structure with multiple extremities or protrusions extending from or bearing upon the structure or surface.

2. Description of the Related Art

Cleaning devices have been in use for years for cleaning walls, vehicles, boats, airplanes and various other structures. Typically, cleaning devices are comprised of a handle with a brush at the distal end thereof. The user applies water in combination with a cleaner solution upon the surface to be cleaned and then utilizes the cleaning device to clean the surface.

The main problem with conventional cleaning devices is that they are inefficient and time consuming. A further problem with conventional cleaning devices is that they do not effectively clean large surface areas nor do they effectively or efficiently clean 360 degrees in a single pass around extremities or protrusions extending from a structure or surface. Another problem with conventional cleaning devices is that they are not designed to clean surfaces of various shapes and contours.

While these devices may be suitable for the particular purpose to which they address, they are not as suitable for effectively and efficiently cleaning a broad surface. Conventional cleaning devices do not provide for efficient cleaning of large surface areas, especially, structure or surfaces with extremities, protrusions or objects placed upon or adjoined to the structure or surface.

In these respects, the cleaning apparatus according to the present invention substantially departs from the conventional concepts and designs of the prior art, and in so doing provides an apparatus primarily developed for the purpose of effectively and efficiently cleaning a broad surface.

BRIEF SUMMARY OF THE INVENTION

In view of the foregoing disadvantages inherent in the known types of cleaning devices now present in the prior art, the present invention provides a new cleaning apparatus construction wherein the same can be utilized for effectively and efficiently cleaning a broad surface. The present invention also allows the user to clean 360 degrees around a protrusion or extremity in a single pass.

The general purpose of the present invention, which will be described subsequently in greater detail, is to provide a new cleaning apparatus that has many of the advantages of the cleaning devices mentioned heretofore and many novel features that result in a new cleaning apparatus which is not anticipated, rendered obvious, suggested, or even implied by any of the prior art cleaning devices, either alone or in any combination thereof.

To attain this, the present invention generally comprises a handle member, a pivot structure attached to a distal end of the handle member, a plurality of arms extending from the pivot structure, a center pad attached to the pivot structure, a plurality of outer pads attached to a distal end of the arms, and a plurality of cover members attached to the pads. The center pad is rotatably attached to the pivot structure for allowing rotation during cleaning of a surface. The outer pads are pivotally attached to the arms for conforming to the shape of the surface being cleaned.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a cleaning apparatus that will overcome the shortcomings of the prior art devices.

A second object is to provide a cleaning apparatus for effectively and efficiently cleaning a broad surface.

Another object is to provide a cleaning apparatus that will clean 360 degrees around extremities or protrusions in one pass.

Another object is to provide a cleaning apparatus that may be utilized upon various structures and surface types.

A further object is to provide a cleaning apparatus that is capable of cleaning about difficult areas and extremities such as but not limited to antennas, side mirror braces, wind deflectors, luggage racks, and stairs on RV's.

An additional object is to provide a cleaning apparatus that reduces the amount of time required to clean a surface.

A further object is to provide a cleaning apparatus that is easy to operate and is comfortable to operate.

Another object is to provide a cleaning apparatus that reduces water consumption during the cleaning of a vehicle or other structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
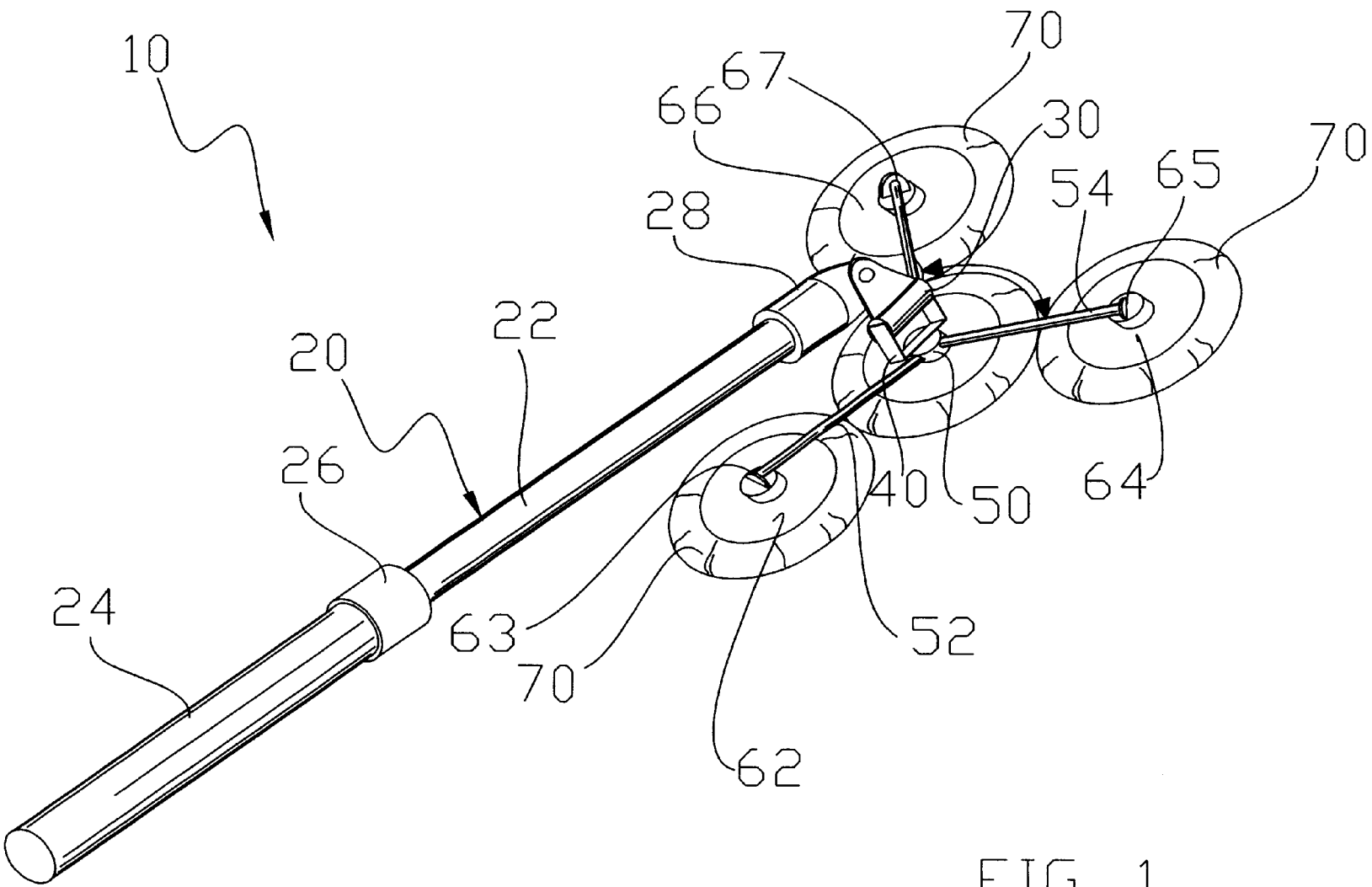
FIG. 1 is an upper perspective view of the present invention.

Turning now descriptively to the drawings, in which similar reference characters denote similar elements throughout the several views, FIGS. 1 through 6 illustrate a cleaning apparatus 10, which comprises a handle member 20, a pivot structure attached to a distal end of the handle member 20, a plurality of arms extending from the pivot structure, a center pad 60 attached to the pivot structure, a plurality of outer pads attached to a distal end of the arms, and a plurality of cover members 70 attached to the pads. The center pad 60 is rotatably attached to the pivot structure for allowing rotation during cleaning of a surface. The outer pads are pivotally attached to the arms for conforming to the shape of the surface being cleaned.

FIGS. 1 through 4 illustrate the handle member 20 having an elongate structure. The handle member 20 may be comprised of a single structure. The handle member 20 may be comprised of a first portion 22 and a second portion 24 in a telescoping manner with a handle coupler 26 attached to the first portion 22 and the second portion 24 for locking a desired telescoped position. Additional portions may be added to the handle member 20 to increase the overall length of the handle member 20 as can be appreciated. The handle member 20 may be comprised of a solid or tubular structure.

Figure 2:
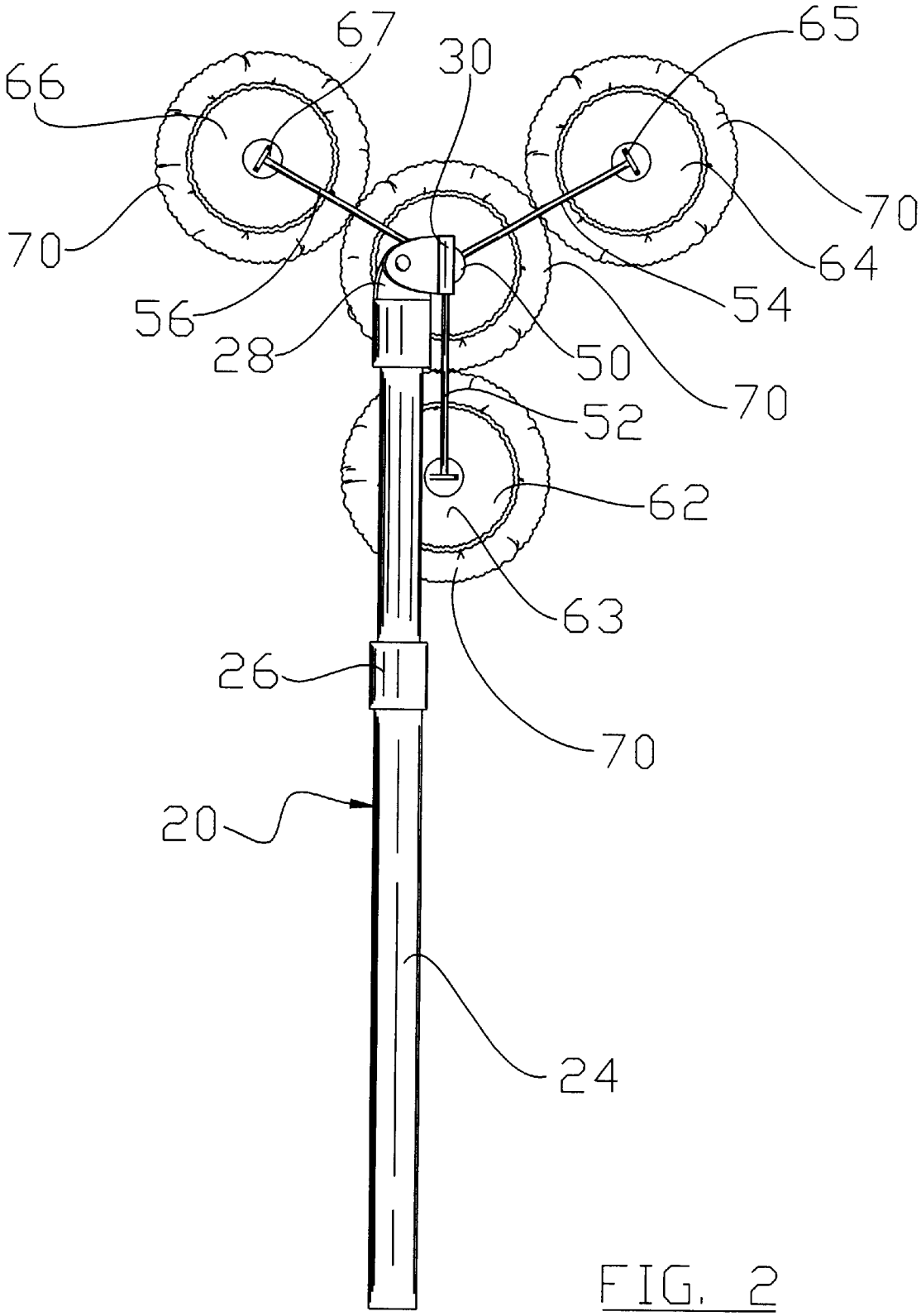
FIG. 2 is a top view of the present invention.
Figure 3:
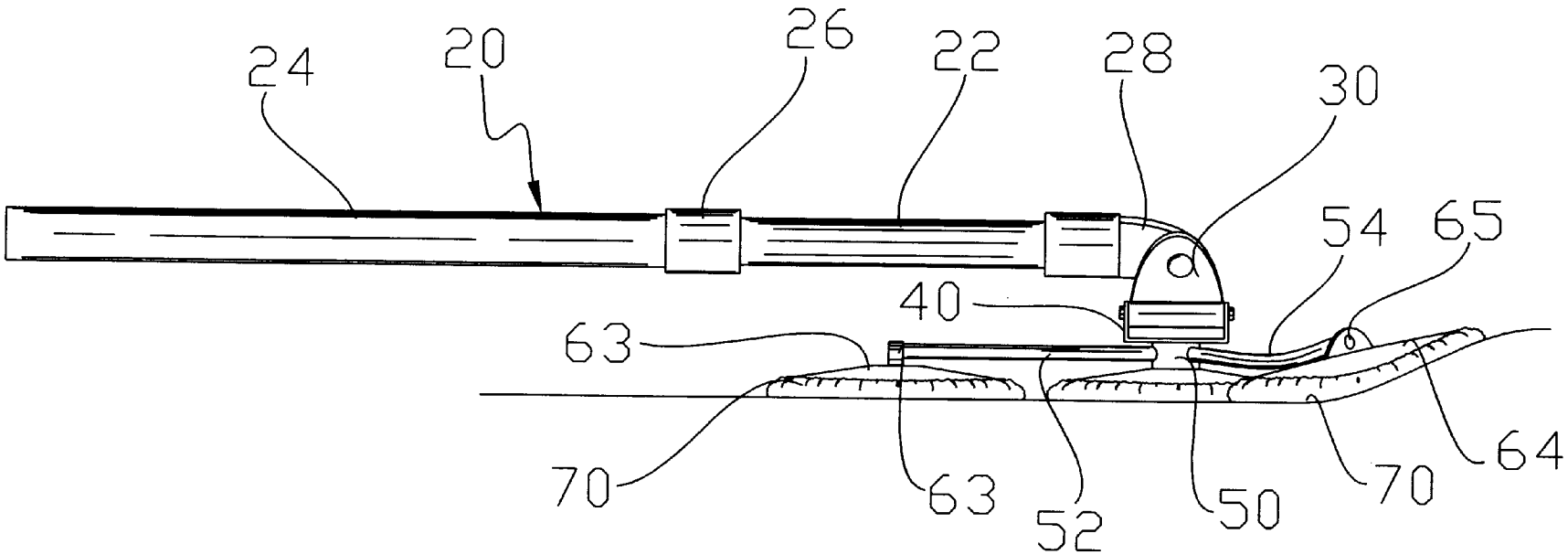
FIG. 3 is a side view of the present invention.
Figure 4:
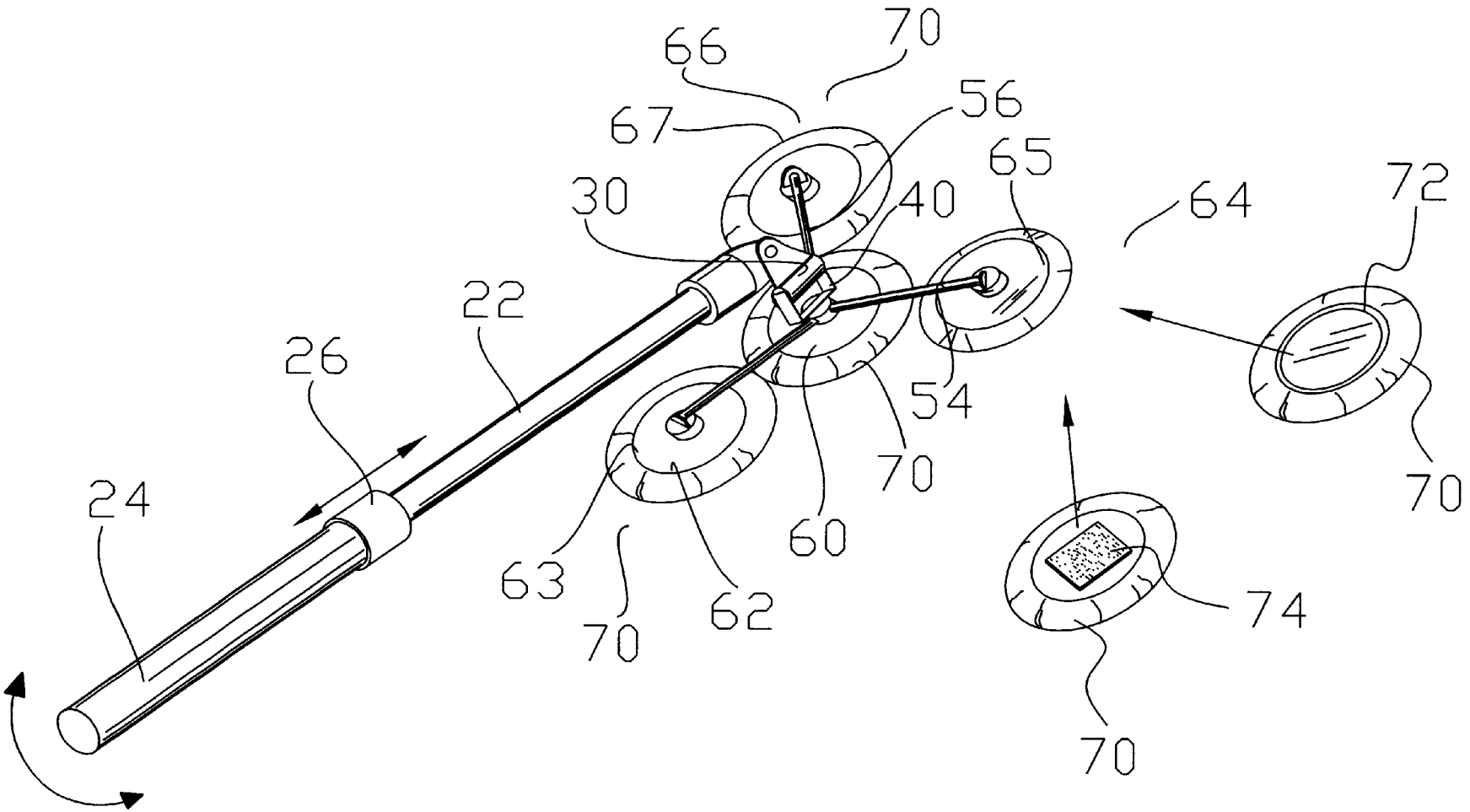
FIG. 4 is an upper perspective view of the present invention with a cleaning cover removed along with an alternative attachment means.
Figure 5:
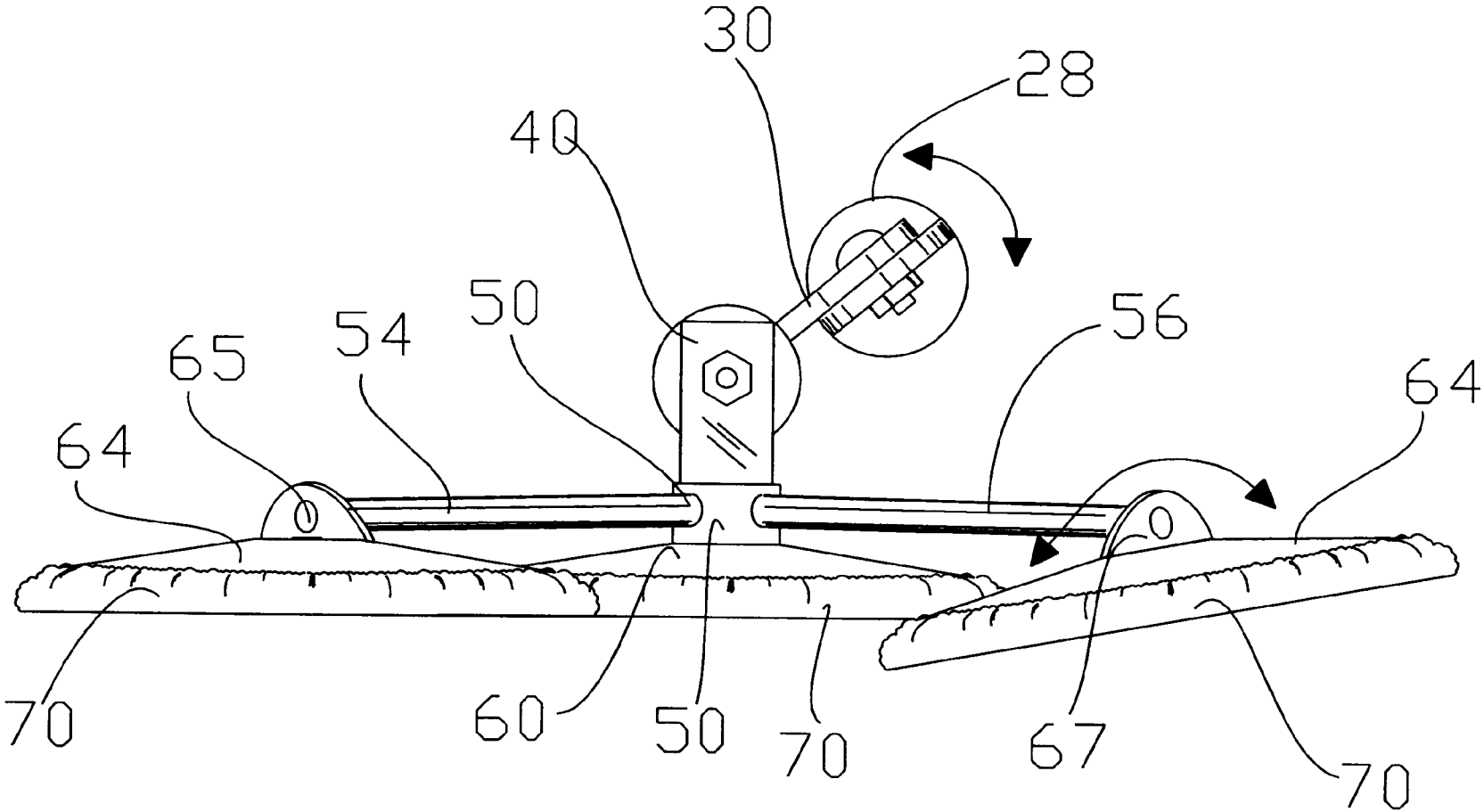
FIG. 5 is a end view of the present invention illustrating the pivoting of a pad attached to an arm.
Figure 6:
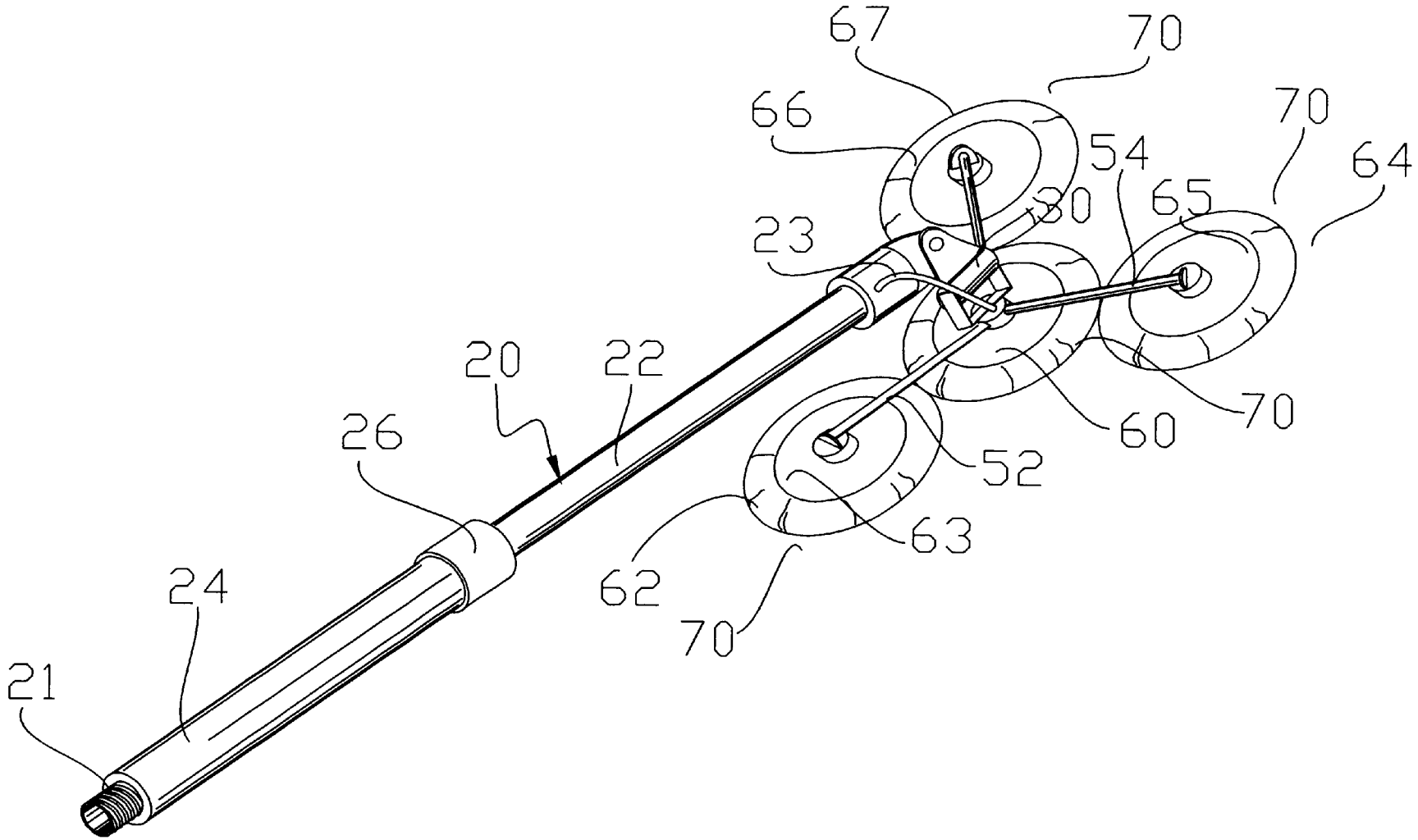
FIG. 6 is an upper perspective view of an alternative embodiment of the present invention illustrating the fluid delivery hose.

An end bracket 28 is attached to the distal end of the handle member 20 as shown in FIGS. 1 through 6 of the drawings. The end bracket 28 is pivotally attached to a pivot bracket 30 as best illustrated in FIGS. 1, 2 and 6 of the drawings. The. pivot bracket 30 is pivotally attached to a base bracket 40 as best illustrated in FIGS. 3 and 4 of the drawings. The pivot bracket 30 preferably has a tubular portion that is secured to the base bracket 40 by an elongate shaft or similar structure. The pivot bracket 30 and the end bracket 28 connection provide a wide range of radial pivoting of the handle member 20 in various directions. It can be appreciated that various pivot or swivel structures may be utilized with the present invention.

A base member 50 is attached to the base bracket 40 opposite of the pivot bracket 30 as best illustrated in FIG. 3 of the drawings. The base member 50 may be movably or non-movably attached to the pivot bracket 30. As shown in FIGS. 1, 2, 4 and 6 of the drawings, a plurality of arms extend from the base member 50.

It is preferable to have three arms comprised of a first arm 52, a second arm 54 and a third arm 56 forming a Y-shaped pattern as best illustrated in FIG. 2 of the drawings with the plurality of arms having a 120 degree angle between thereof. The angle between each of the arms 52, 54, 56 is preferably equal, however varying angles may be utilized. The arms 52, 54, 56 are preferably comprised of a flexible and resilient material for allowing additional conforming to the surface shape.

As shown in FIG. 2 of the drawings, a first pad 62 is attached to the first arm 52, a second pad 64 is attached to the second arm 54, and a third pad 66 is attached to the third arm 56. The pads 62, 64, 66 are preferably attached in a pivoting or swivel manner to the distal ends of the arms 52, 54, 56 by a first bracket 63, a second bracket 65 and a third bracket 67 respectively for conforming to varying contours of a surface. As best illustrated in FIG. 5 of the drawings, the pads 62, 64, 66 preferably pivot along a plane transverse to the longitudinal axis of the arms 52, 54, 56.

As shown in FIGS. 1, 3, 4 and 5 of the drawings, a center pad 60 is attached to the base member 50 opposite of the base bracket 40. The center pad 60 may be non-movably or movably attached to the base member 50. For example, the center pad 60 may be rotatably attached to the base member 50 for allowing rotation of the center pad 60 during cleaning of a surface.

The pads 60, 62, 64, 66 preferably have a broad structure that may have various shapes and sizes. The pads 60, 62, 64, 66 may have a circular, square, oval or other well-known shape. The pads 60, 62, 64, 66 also are preferably comprised of a flexible and resilient material such as but not limited to foam, rubber or similar material. The pads 60, 62, 64, 66 may or may not be absorbent of fluids such as water or cleaning solution. The pads 60, 62, 64, 66 may or may not touch one another. In addition, the pads 60, 62, 64, 66 may form various shapes and patterns as desired. The cleaning action and structure of the pads 60, 62, 64, 66 allows for 360 degree cleaning around extremities.

As shown in FIG. 2 of the drawings, a cover member 70 is attached to each of the pads 60, 62, 64, 66. The cover member 70 has an inner rim 72 which is positionable about the pads 60, 62, 64, 66 in a taut manner. The inner rim 72 may be comprised of an elastic or string structure for allowing tightening upon the respective pads 60, 62, 64, 66.

Alternatively, a hook and loop fastener 74 may be attached. to an inner surface of the cover member 70 and to the bottom surface of the pads 60, 62, 64, 66 as shown in FIG. 4. Various other fasteners may be utilized to construct the cover member 70.

The cover member 70 may be comprised of various materials such as but not limited to cloth, synthetic, sheepskin, bristles, foam and related materials. The cover member 70 may also be integrally formed into the pads 60, 62, 64, 66 or permanently attached to the pads 60, 62, 64, 66 in various manners.

FIG. 6 illustrates an alternative embodiment of the present invention. An end coupler 21 is attached to the distal end of the handle member 20 for coupling to a water hose. The handle member 20 is comprised of a tubular structure for allowing the water to flow through the handle member 20. A delivery tube 23 is fluidly connected to the opposing end of the handle member 20 and then fluidly connected to the base member 50 for dispensing water through an orifice in the base member 50 to the center pad 60. It can be appreciated that the delivery tube 23 may be directly connected to the center pad 60.

In use, the user may apply the cleaning solution directly to the surface or place the end of the present invention with the pads 60, 62, 64, 66 into the cleaning solution. The user then applies the pads 60, 62, 64, 66 with the cover members 70 upon the surface to be cleaned moving in various directions until the desired cleanliness is achieved. During the cleaning of the surface, the pads 62, 64, 66 are allowed to rotate upon the arms 52, 54, 56 in order to conform to the shape of the surface. In addition, the center pad 60 may rotate freely in order to increase the cleaning action upon the surface. Also, each of the pads 60, 62, 64, 66 may flex and conform to the surface shape in order to engages a significant portion of the surface. When finished, the user may remove each cover member 70 from the pads 60, 62, 64, 66 and either clean or replace.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning apparatus, comprising:

a handle member;

a pivot structure attached to a distal end of said handle member;

a plurality of arms extending from said pivot structure in a radial manner;

a center pad attached to said pivot structure; and an outer pad attached to each of said plurality of arms.

2. The cleaning apparatus of claim 1, wherein said center pad is rotatably attached to said pivot structure.

3. The cleaning apparatus of claim 1, wherein said center pad is non-movably attached to said pivot structure.

4. The cleaning apparatus of claim 1, wherein said plurality of arms are comprised of a first arm, a second arm and a third arm.

5. The cleaning apparatus of claim 4, wherein said plurality of arms have a 120 degree angle between thereof.

6. The cleaning apparatus of claim 1, including a center cover member positionable about said center pad and an outer cover member positionable about each outer pad.

7. The cleaning apparatus of claim 6, wherein said center cover member and said outer cover members are each have an elastic inner rim.

8. The cleaning apparatus of claim 6, wherein said center cover member and said outer cover member are secured to said center pad and said outer pad by a hook and loop fastener.

9. The cleaning apparatus of claim 1, wherein said plurality of arms are comprised of a flexible and resilient material.

10. The cleaning apparatus of claim 1, wherein said pivot structure is comprised of a:

an end bracket attached to said handle member;

a pivot bracket pivotally attached to said end bracket;

a base bracket pivotally attached to said pivot bracket; and a base member attached to said base bracket with said plurality of arms and said center pad connected to said base member.

11. A cleaning apparatus, comprising:

a handle member having a tubular structure and an end coupler for connecting to a water hose;

a pivot structure attached to a distal end of said handle member;

a plurality of arms extending from said pivot structure in a radial manner;

a center pad attached to said pivot structure;

a delivery hose fluidly connected to said handle member and to said center pad; and an outer pad attached to each of said plurality of arms.

12. The cleaning apparatus of claim 11, wherein said center pad is rotatably attached to said pivot structure.

13. The cleaning apparatus of claim 11, wherein said center pad is non-movably attached to said pivot structure.

14. The cleaning apparatus of claim 11, wherein said plurality of arms are comprised of a first arm, a second arm and a third arm.

15. The cleaning apparatus of claim 14, wherein said plurality of arms have a 120 degree angle between thereof.

16. The cleaning apparatus of claim 11, including a center cover member positionable about said center pad and an outer cover member positionable about each outer pad.

17. The cleaning apparatus of claim 16, wherein said center cover member and said outer cover members each have an elastic inner rim.

18. The cleaning apparatus of claim 16, wherein said center cover member and said outer cover members are secured to said center pad and said outer pad by a hook and loop fastener.

19. The cleaning apparatus of claim 11, wherein said plurality of arms are comprised of a flexible and resilient material.

20. The cleaning apparatus of claim 11, wherein said pivot structure is comprised of a:

an end bracket attached to said handle member;

a pivot bracket pivotally attached to said end bracket;

a base bracket pivotally attached to said pivot bracket; and a base member attached to said base bracket with said plurality of arms and said center pad connected to said base member.

* * * * *